US009482401B2

(12) United States Patent
Yagi

(10) Patent No.: US 9,482,401 B2
(45) Date of Patent: Nov. 1, 2016

(54) VEHICULAR ILLUMINATION LAMP

(75) Inventor: Takayuki Yagi, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 584 days.

(21) Appl. No.: 13/428,085

(22) Filed: Mar. 23, 2012

(65) Prior Publication Data

US 2012/0243250 A1 Sep. 27, 2012

(30) Foreign Application Priority Data

Mar. 23, 2011 (JP) ..... 2011-063687
Dec. 22, 2011 (JP) ..... 2011-281012

(51) Int. Cl.
*F21S 8/10* (2006.01)

(52) U.S. Cl.
CPC ..... *F21S 48/1154* (2013.01); *F21S 48/1159* (2013.01); *F21S 48/1258* (2013.01); *F21S 48/1266* (2013.01)

(58) Field of Classification Search
CPC ..... F21S 48/1154; F21S 48/1258; F21S 48/1159; F21S 48/1266
USPC ..... 362/520, 538, 475, 476, 507, 509, 362/296.1, 311.06, 311.12
See application file for complete search history.

(56) References Cited

U.S. PATENT DOCUMENTS 4,959,757 A * 9/1990 Nakata ..... 362/518
5,158,350 A * 10/1992 Sato ..... 362/538
5,735,595 A * 4/1998 Nederpel et al. ..... 362/223
5,897,196 A * 4/1999 Soskind et al. ..... 362/507
7,281,830 B2 * 10/2007 Ishida ..... 362/538
7,648,262 B2 * 1/2010 Tanaka ..... 362/509
8,469,567 B2 * 6/2013 Futami ..... 362/545
8,920,012 B2 * 12/2014 Yagi ..... F21S 48/1258 362/522
2007/0058386 A1 * 3/2007 Albou ..... 362/520
2008/0253141 A1 10/2008 Nakada et al.
2009/0257240 A1 * 10/2009 Koike ..... 362/538
2009/0268481 A1 10/2009 Nishihata (Continued)

FOREIGN PATENT DOCUMENTS

CN 101761847 A 6/2010
CN 101298906 B 9/2010

(Continued)

OTHER PUBLICATIONS

Office Action, dated May 16, 2013, issued by the Korean Patent Office in counterpart Korean Application No. 10-2012-0029382.

(Continued)

*Primary Examiner* — Stephen F Husar
*Assistant Examiner* — Danielle Allen
(74) *Attorney, Agent, or Firm* — Sughrue Mion, PLLC

(57) ABSTRACT

A vehicular illumination lamp includes a projection lens configured to output forward, as light that is parallel with an axial line extending in a lamp front-rear direction, light emitted from a prescribed point on the axial line, and a light source disposed in the rear of the projection lens. A front surface of the projection lens is a convex free surface and a perimeter of the front surface extends approximately along a plane that is perpendicular to the axial line. A rear surface of the projection lens is a curved surface which is formed so that light emitted from the prescribed point and incident on the projection lens is output from the projection lens as light that is parallel with the axial line.

6 Claims, 14 Drawing Sheets

(56) References Cited

U.S. PATENT DOCUMENTS

| | | | | |
|---|---|---|---|---|
| 2010/0046243 | A1* | 2/2010 | Yatsuda | 362/538 |
| 2011/0063874 | A1 | 3/2011 | Yatsuda et al. | |

FOREIGN PATENT DOCUMENTS

| | | | |
|---|---|---|---|
| DE | 41 28 995 | A1 | 3/1993 |
| EP | 2 112 429 | A1 | 10/2009 |
| EP | 2 237 080 | A1 | 10/2010 |
| EP | 2 280 214 | A1 | 2/2011 |
| JP | 2000-322913 | A | 11/2000 |
| JP | 2006127819 | A | 5/2006 |
| JP | 2007184239 | A | 7/2007 |
| JP | 2008-234858 | A | 10/2008 |
| JP | 2009043543 | A | 2/2009 |
| JP | 2010-080306 | A | 4/2010 |
| JP | 2010-153180 | A | 7/2010 |

OTHER PUBLICATIONS

Search Report dated Nov. 3, 2014 issued by the European Patent Office in counterpart European Application No. 12160969.7.

Office Action dated Apr. 2, 2014 issued by the State Intellectual Property Office of P.R.C. in counterpart Chinese Patent Application No. 201210080720.4.

Office Action dated Aug. 22, 2014, issued by the Korean International Patent Office in counterpart Korean Application No. 10-2012-0029382.

Communication dated Jun. 30, 2015 (drafting date of Jun. 23, 2015) issued by Japanese Intellectual Property Office in Japanese Patent Application No. 2011-281012.

* cited by examiner

VEHICULAR ILLUMINATION LAMP

CROSS-REFERENCE TO RELATED APPLICATION(S)

The present application claims the benefit of priority of Japanese Patent Application No. 2011-063687, filed on Mar. 23, 2011 and Japanese Patent Application No. 2011-281012, filed on Dec. 22, 2011. The disclosures of these applications are incorporated herein by reference.

BACKGROUND

1. Technical Field

The present disclosure relates to a vehicular illumination lamp which is equipped with a projection lens.

2. Related Art

As described in JP-A-2006-127819 and JP-A-2009-43543, it is known it have vehicular illumination lamps that are configured in such a manner that light emitted from a prescribed point on the axial line extending in the lamp front-rear direction is output forward as light that is parallel with the axial line by a projection lens that is located in front of a light source.

The projection lens of a vehicular illumination lamp described in JP-A-2006-127819 is a planoconvex lens with a convex front surface.

On the other hand, the projection lens of a vehicular illumination lamp described in JP-A-2009-43543 is configured in such a manner that plural lens pieces having the same shape which are fan-shaped portions having a prescribed central angle cut out of an ellipsoidal lens whose front surface is a convex, ellipsoidal surface are connected to each other in the circumferential direction.

Whereas the front surface of the projection lens described in JP-A-2006-127819 has a circular perimeter shape, the following problem arises if it is attempted to give the perimeter of its front surface a non-circular shape to increase the degree of freedom of lamp designing.

In the projection lens described in JP-A-2006-127819, if it is attempted to give the perimeter of its front surface an shape that is close to a rectangle when viewed from the front side of the lamp as in a front surface 2*a* of a projection lens 2 shown in FIG. 14A, the projection lens is chamfered at four locations in the perimeter. In the case of the projection lens 2, new end surfaces 2*b* are formed so as to extend rearward from four peripheral positions of the front surface 2*a*. However, a problem arises that if light emitted from a light source reaches and exits from the end surfaces 2*b*. This light becomes stray light that is not controlled as lamp illumination light.

To prevent occurrence of such stray light, as shown in FIG. 14B, it is necessary to cover the end surfaces 2*b* with a lens holder 4. However, in this case, the front end surface 4*a* of the lens holder 4 is formed with projections 4*a*1 at plural positions, whereby the appearance of the lamp is impaired.

On the other hand, in the projection lens described in JP-A-2009-43543, even if the perimeter of its front surface is given a non-circular shape, end surfaces that are formed in the perimeter can be made so small that almost no stray light is produced. However, in this projection lens, ridge lines are formed in the front surface at the connecting portions between the fan-shaped lens pieces. This impairs the appearance of the lamp.

SUMMARY

One or more exemplary embodiments of the present invention provide a vehicular illumination lamp having a projection lens which can be prevented from being impaired in appearance even if the perimeter of its front surface is given a non-circular shape.

One aspect to the invention attains the above object by improving the configuration of a projection lens.

A vehicular illumination lamp according to an exemplary embodiment of the invention includes a projection lens configured to output forward, as light that is parallel with an axial line extending in a lamp front-rear direction, light emitted from a prescribed point on the axial line, and a light source disposed in the rear of the projection lens. A front surface of the projection lens is a convex free surface and a perimeter of the front surface extends approximately along a plane that is perpendicular to the axial line. A rear surface of the projection lens is a curved surface which is formed so that light emitted from the prescribed point and incident on the projection lens is output from the projection lens as light that is parallel with the axial line.

No limitations are imposed on the type of the light source. For example, a light-emitting diode chip, a discharge light-emitting portion of a discharge bulb, a filament of a halogen bulb, or the like can be employed to form the light source. No limitations are imposed on the positional relationship between the light source and the prescribed point. Furthermore, the lamp configuration may be such that light emitted from the light source reaches the projection lens as either direct light or indirect light such as reflection light.

The "convex free surface" means a curved surface each of whose cross sections including the axial line is a convex free curve (i.e., non-quadratic curve).

The "perimeter of the front surface" is a free curve which may either be formed only by curved lines or be formed so as to also include straight lines.

As described above, the vehicular illumination lamp according to an aspect of the invention is configured in such a manner that the projection lens which is disposed in front of the light source outputs forward, as light that is parallel with the axial line, light that is emitted from the prescribed point on the axial line extending in the lamp front-rear direction. The front surface of the projection lens is a convex free surface, and the perimeter of the front surface extends approximately along a plane that is perpendicular to the axial line. The rear surface of the projection lens is a curved surface that is formed so that light emitted from the prescribed point and incident on the projection lens is output from the projection lens as light that is parallel with the axial line. The thus-configured vehicular illumination lamp provides the following advantages.

In the vehicular illumination lamp according to an aspect of the invention, since the front surface of the projection lens is a convex free surface, the degree of freedom of lamp designing is increased.

Since the perimeter of the front surface of the projection lens according to an aspect of the invention extends approximately along a plane that is perpendicular to the axial line extending in the lamp front-rear direction, almost no end surfaces that may produce stray light are formed in the perimeter of the projection lens even if the perimeter has a non-circular shape. This makes it unnecessary to cover such end surfaces with a lens holder which supports the projection lens. Therefore, the problem is prevented that the lamp is impaired in appearance due to formation of projections at plural positions in a front end surface of a lens holder.

In the vehicular illumination lamp according to an aspect of the invention, the rear surface of the projection lens is a curved surface that is formed so that light emitted from the prescribed point and incident on the projection lens is output from the projection lens as light that is parallel with the axial line. Therefore, light emitted from the prescribed point can be output from the projection lens as light that is parallel with the axial line though the front surface is a smooth free surface having no ridge lines. This prevents the problem that the lamp is impaired in appearance due to formation of ridge lines in the front surface of the projection lens.

As described above, according to an aspect of the invention, the vehicular illumination lamp having the projection lens is prevented from being impaired in appearance even if the front surface of the projection lens has a non-circular perimeter shape.

In the above configuration, a lens holder which supports the projection lens may be disposed so as to surround the projection lens. In this case, the perimeter of the front surface of the projection lens can be covered with the lens holder. Since almost no end surfaces are formed in the perimeter of the front surface of the projection lens, a front end surface of the lens holder can be made a flat surface having no projections or recesses over its entire circumference.

BRIEF DESCRIPTION OF THE DRAWINGS

The above and other aspects of the present invention will become more apparent from the following description of exemplary embodiments, taken in conjunction with the accompanying drawings of which.

DETAILED DESCRIPTION

The matters defined in the description are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness. an exemplary embodiment of the present invention will be hereinafter described with reference to the drawings.

Figure 1:
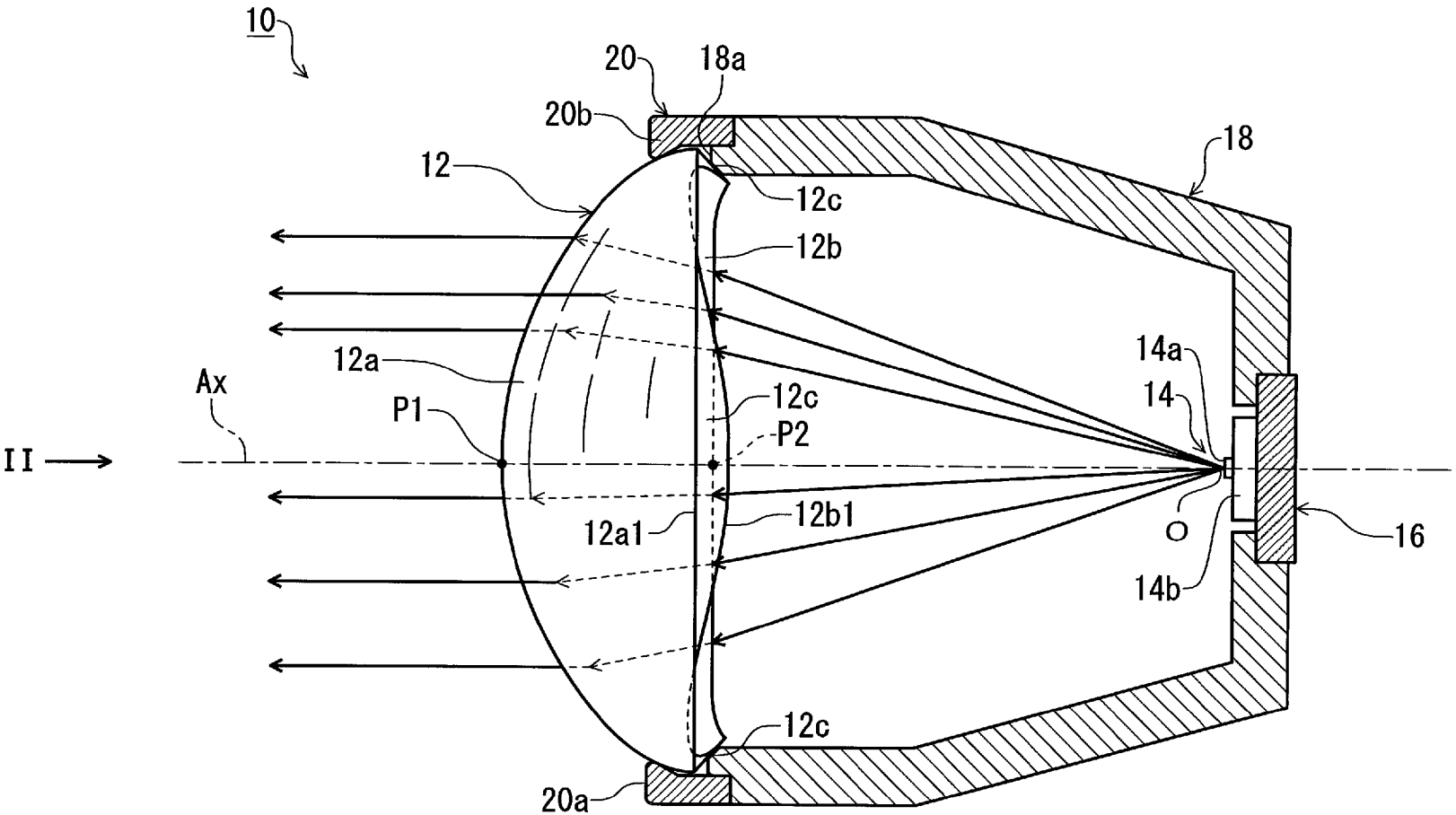
FIG. 1 is a side sectional view of a vehicular illumination lamp according to an exemplary embodiment of the invention.

FIG. 1 is a side sectional view of a vehicular illumination lamp 10 according to the exemplary embodiment of the invention.

As shown in FIG. 1, the vehicular illumination lamp 10 according to the exemplary embodiment is composed of a projection lens 12, a light source 14 disposed in the rear of the projection lens 12, a light source support member 16 which supports the light source 14, a housing 18 which supports the light source support member 16, and a lens holder 20 which supports the projection lens 12. The projection lens outputs forward, as light that is parallel with the axial line Ax extending in the lamp front-rear direction, light that is emitted from a prescribed point O on the axial line Ax.

The vehicular illumination lamp 10 is used as a lamp unit of a vehicular headlamp in a state that it is incorporated in a lamp body or the like (not shown) in an optical-axis-adjustable manner. When an optical axis adjustment has completed, the vehicular illumination lamp 10 emits light for formation of part of a high-beam light distribution pattern in a state that it is oriented so that its axial line Ax extends in the front-rear direction of the vehicle.

The light source 14 is equipped with a light-emitting chip 14*a* which is a white light-emitting diode and has a rectangular light-emitting surface that is longer in the horizontal direction and a substrate 14*b* which supports the light-emitting chip 14*a*. The light source 14 is directed forward with the light emission center of the light-emitting chip 14*a* located at a prescribed point O. The light source 14 is supported by the light source support member 16 via the substrate 14*b*.

The housing 18 has a front end opening portion 18*a* which is in contact with the projection lens 12 from the rear side.

The lens holder 20 is a ring-shaped member and is disposed so as to surround the projection lens 12. The lens holder 20 is attached to the front end opening portion 18*a* of the housing 18 from the front side in a state that the projection lens 12 is in contact with the front end opening portion 18*a* of the housing 18, whereby the lens holder 20 positions and fixes the projection lens 12.

Figure 2:
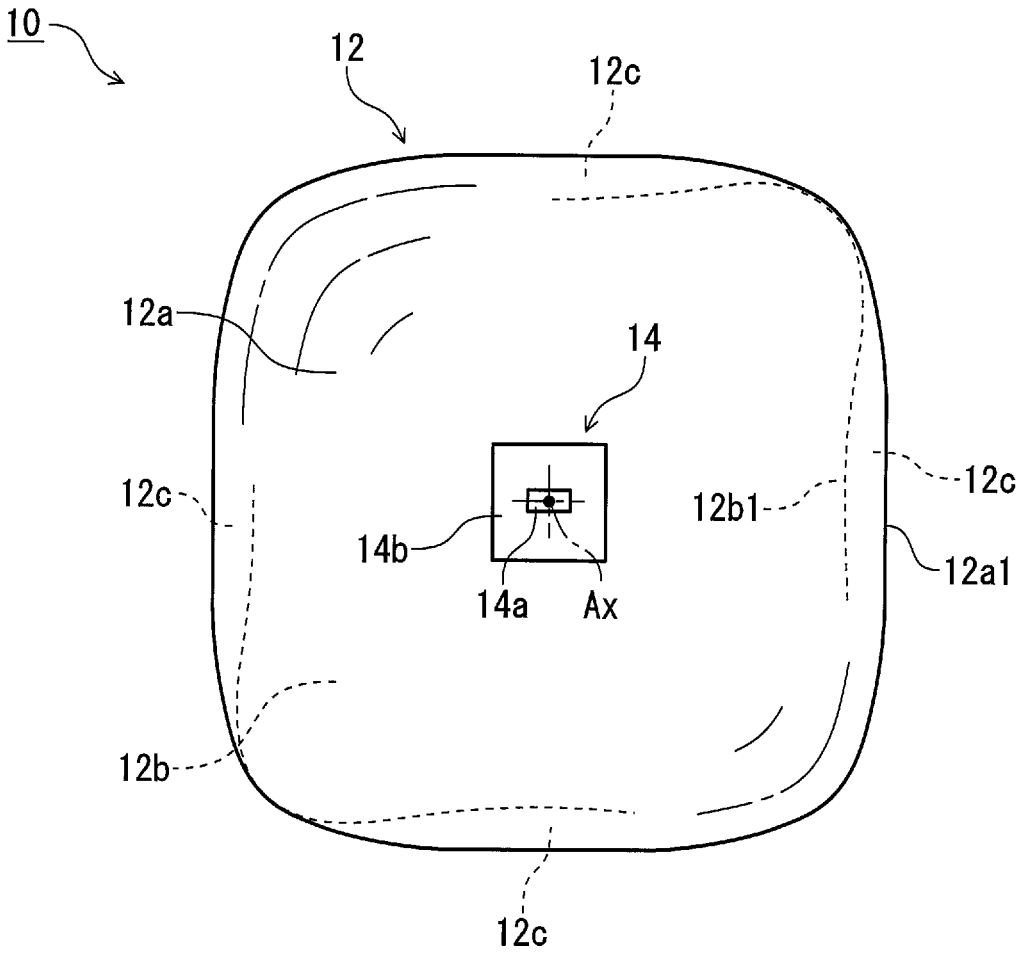
FIG. 2 is a front view, as viewed from the direction II in FIG. 1, showing only important members of the vehicular illumination lamp.
Figure 3:
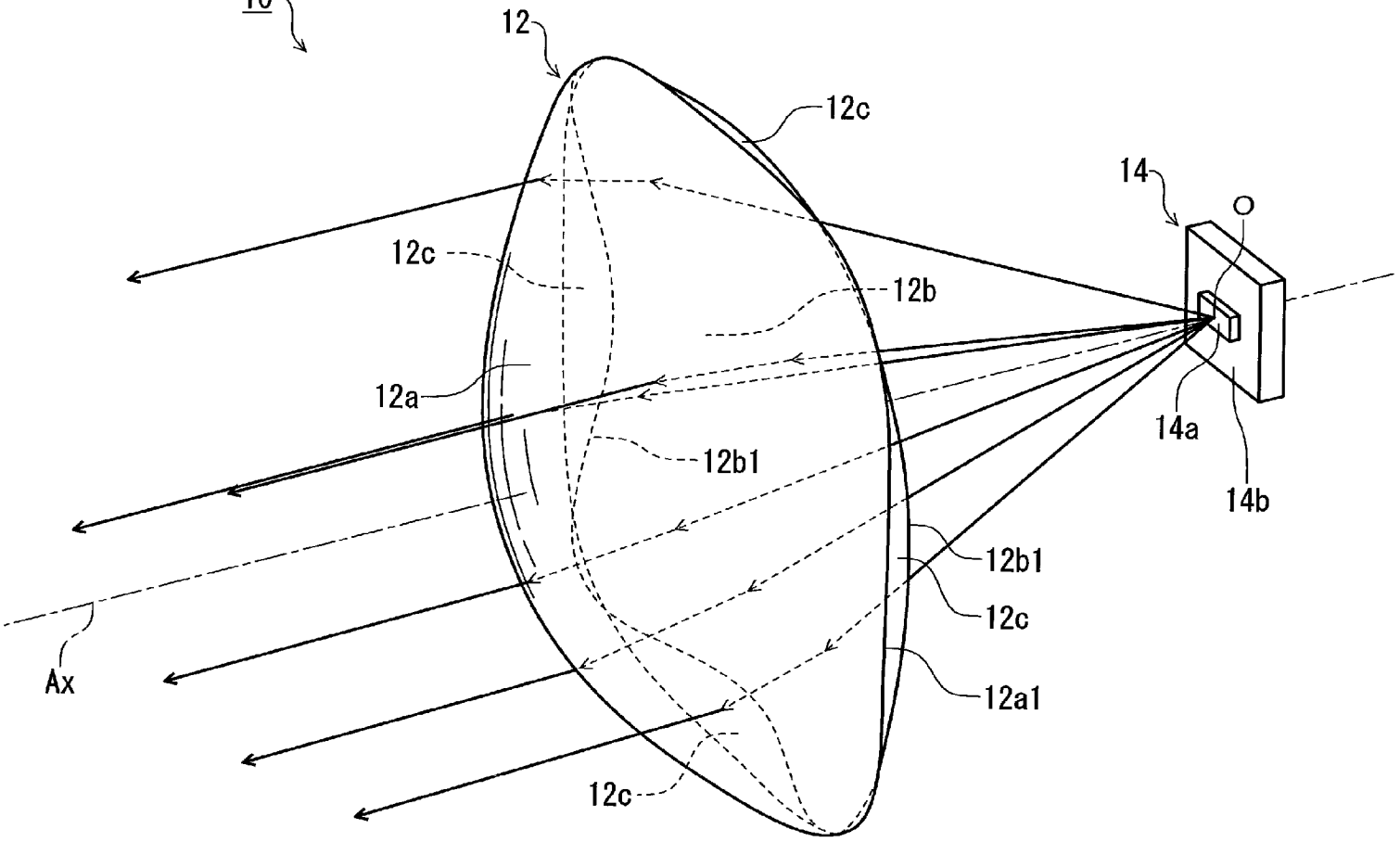
FIG. 3 is a perspective view showing the important members of the vehicular illumination lamp.

FIG. 2 is a front view, as viewed from the direction II in FIG. 1, showing only the projection lens 12 and the light source 14 which are important members of the vehicular illumination lamp 10. FIG. 3 is a perspective view showing the projection lens 12 and the light source 14.

As shown in FIGS. 2 and 3, the projection lens 12 has an approximately square external shape when viewed from the front side. The projection lens 12 is symmetrical with respect to both of the vertical plane including the axial line Ax and the horizontal plane including the axial line Ax.

A front surface 12*a* of the projection lens 12 is a convex free surface. A perimeter 12*a*1 of the front surface 12*a* extends along a plane that is perpendicular to the axial line Ax. In a front view, four portions of the perimeter 12*a*1 are straight lines that are parts of the respective sides of a square and the other portions are curved lines.

On the other hand, a rear surface 12*b* of the projection lens 12 is a curved surface that is formed so that light emitted from the prescribed point O and incident on the projection lens 12 is output from the projection lens 12 as light that is parallel with the axial line Ax. An example specific method for forming the rear surface 12*b* is as follows.

Referring to FIG. 1, points P1 and P2 are set as points where the axial line Ax intersects the front surface 12*a* and the rear surface 12*b*, respectively. The position of a point in the vicinity of point P2 on the rear surface 12*b* which corresponds to a normal direction at a point that is in the vicinity of point P1 is determined so that exit light from the point in the vicinity of point P1 becomes parallel with the axial line Ax. Then, a normal direction at the point in the vicinity of point P2 which corresponds to the light-emitting chip 14*a* is determined. Next, the position of a point adjacent to the point in the vicinity of point P2 on the rear surface 12*b* which corresponds to a normal direction at a point that is adjacent to the point in the vicinity of point P1 is determined so that exit light from the point adjacent to the point in the vicinity of point P1 becomes parallel with the axial line Ax. Then, a normal direction at the point adjacent to the point in the vicinity of point P2 which corresponds to the light-emitting chip 14*a* is determined. This calculation is thereafter performed repeatedly, whereby the positions of points in the rear surface 12*b* that correspond to points in the entire area of the front surface 12*a* are determined.

The rear surface 12*b* formed in the above-described manner is such that its perimeter 12*b*1 is formed in a wave-shape in the front-rear direction with respect to a plane that is perpendicular to the axial line Ax. Four portions, respectively located over, under, on the left of, and on the right of the axial line Ax, of the perimeter 12*b*1 of the rear surface 12*b* (i.e., portions corresponding to the respective straight portions of the perimeter 12*a*1 of the front surface 12*a*) are deviated rearward from the perimeter 12*a*1 of the front surface 12*a*. On the other hand, the portions located between these four portions (i.e., corner portions corresponding to the corner portions of the perimeter 12*a*1 of the front surface 12*a*) are deviated forward from the perimeter 12*a*1 of the front surface 12*a*.

Generally bow-shaped slant surfaces 12*c* are formed between the perimeter 12*a*1 of the front surface 12*a* and the four respective portions, located over, under, on the left of, and on the right of the axial line Ax, of the perimeter 12*b*1 of the rear surface 12*b*.

These four slant surfaces 12*c* of the projection lens 12 are brought into contact with the front end opening portion 18*a* of the housing 18.

Figure 4:
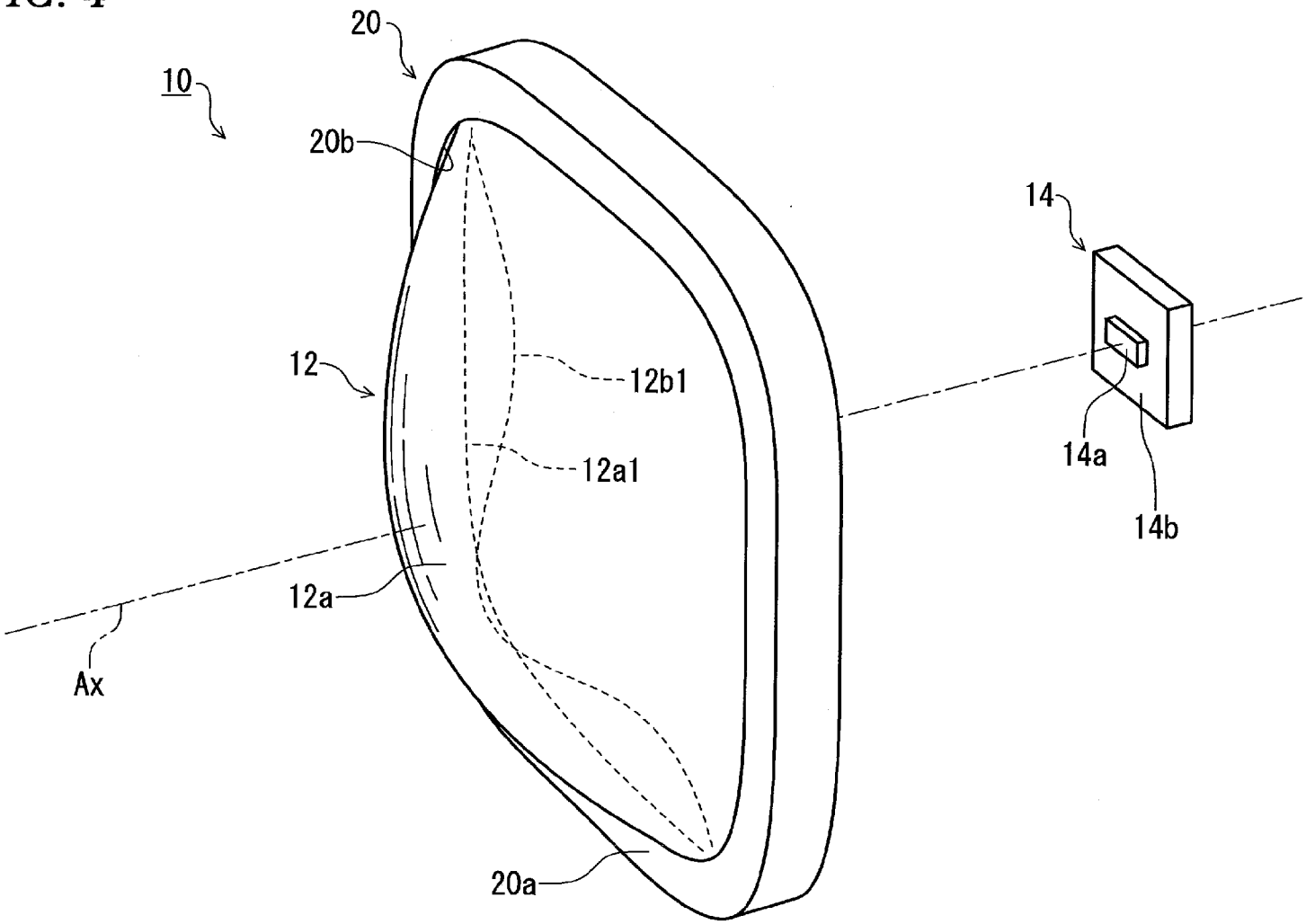
FIG. 4 is a perspective view which shows a lens holder 20 in addition to the important members of the vehicular illumination lamp.

FIG. 4 is a perspective view which shows the lens holder 20 in addition to the members of the vehicular illumination lamp 10 discussed above.

As shown in FIG. 4, a front end surface 20*a* of the lens holder 20 extends along a plane that is perpendicular to the axial line Ax. A flange portion 20*b* extends inward from the front end portion of the lens holder 20, and the inward flange portion 20*b* is brought into contact with a portion, in the vicinity of the perimeter 12*a*1, of the front surface 12*a* of the projection lens 12.

Figure 5:
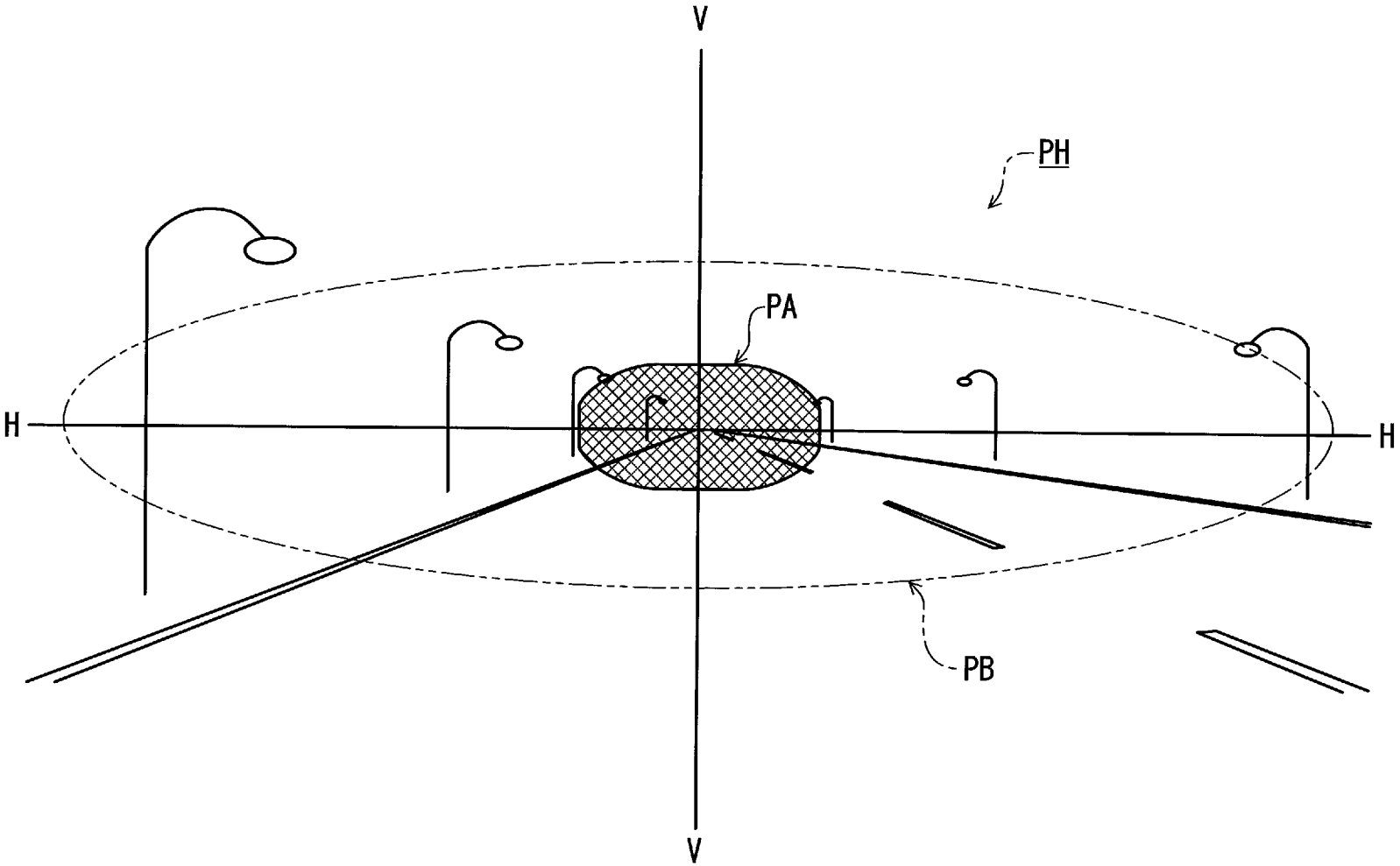
FIG. 5 shows, in seethrough form, a light distribution pattern PA that is formed on a virtual vertical screen located 25 m before the vehicular illumination lamp by light that is projected forward by the vehicular illumination lamp.

FIG. 5 shows, in seethrough form, a light distribution pattern PA that is formed on a virtual vertical screen located 25 m before the vehicular illumination lamp 10 according to the exemplary embodiment by light that is projected forward by the vehicular illumination lamp 10.

As shown in FIG. 5, the light distribution pattern PA is a spot-like light distribution pattern which is longer in the horizontal direction and is formed around a center H-V which is a forward vanishing point. And the light distribution pattern PA is part of a high-beam light distribution pattern PH. That is, the high-beam light distribution pattern PH is a composite light distribution pattern of the light distribution pattern PA and a diffused light distribution pattern PB which is formed by light that is projected forward by another lamp unit (not shown). A hot zone (high-luminance region) of the high-beam light distribution pattern PH is mainly formed by the light distribution pattern PA.

The light distribution pattern PA is formed as a spot-like light distribution pattern around the center H-V because all of light that is emitted from the prescribed point O and output forward by the projection lens 12 is parallel with the axial line Ax and the light emission center of the light-emitting chip 14*a* is located at the prescribed point O. The reason why the light distribution pattern PA is formed as a light distribution pattern that is longer in the horizontal direction is that the light-emitting chip 14*a* is has a rectangular shape that is also longer in the horizontal direction.

Next, advantages of the exemplary embodiment will be described.

The vehicular illumination lamp 10 according to the exemplary embodiment is configured in such a manner that the projection lens 12 which is disposed in front of the light source 14 outputs forward, as light that is parallel with the axial line Ax, light that is emitted from the prescribed point O on the axial line Ax extending in the lamp front-rear direction. The front surface 12*a* of the projection lens 12 is a convex free surface, and the perimeter 12*a*1 of the front surface 12*a* extends along a plane that is perpendicular to the axial line Ax. The rear surface 12*b* of the projection lens 12 is a curved surface that is formed so that light emitted from the prescribed point O and incident on the projection lens 12 is output from the projection lens 12 as light that is parallel with the axial line Ax. The thus-configured vehicular illumination lamp 10 provides the following advantages.

In the vehicular illumination lamp 10 according to the exemplary embodiment, since the front surface 12*a* of the projection lens 12 is a convex free surface, the degree of freedom of lamp designing is increased.

Figure 14B:
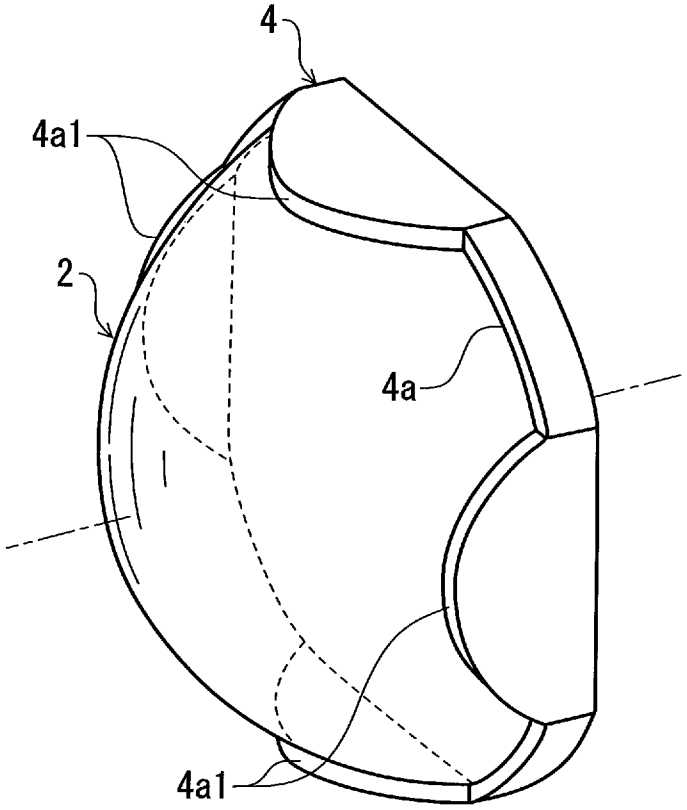
FIG. 14 is a perspective view showing a related art lens.
Figure 14A:
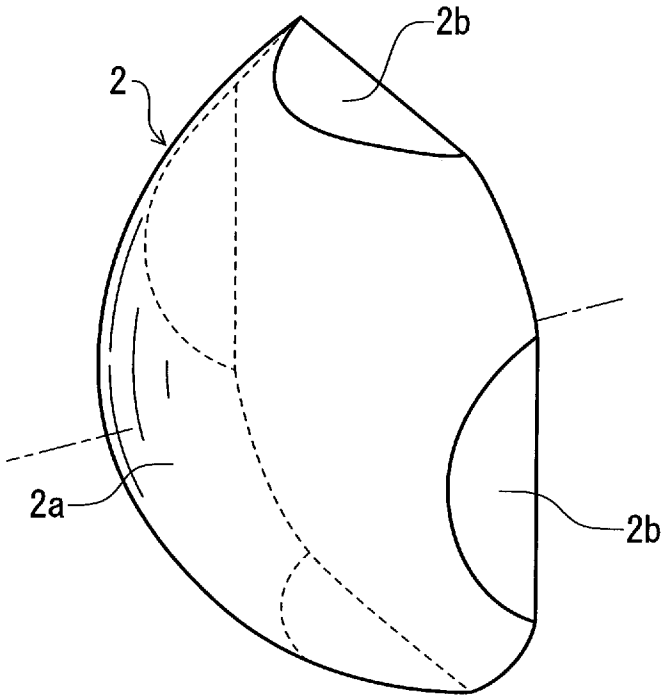

Since the perimeter 12*a*1 of the front surface 12*a* of the projection lens 12 extends along a plane that is perpendicular to the axial line Ax extending in the lamp front-rear direction, no end surfaces that may produce stray light are formed in the perimeter 12*a*1 of the projection lens 12 though the perimeter 12*a*1 has a non-circular shape (i.e., square shape). This makes it unnecessary to cover such end surfaces with the lens holder 20 which supports the projection lens 12. Therefore, the lens holder 20 need not be configured like the lens holder 4 shown in FIG. 14B in which the front end surface 4*a* is formed with the projections 4*a*1 at the plural positions. This prevents the problem that the lamp 10 is impaired in appearance.

In the vehicular illumination lamp 10 according to the exemplary embodiment, the rear surface 12*b* of the projection lens 12 is a curved surface that is formed so that light emitted from the prescribed point O and incident on the projection lens 12 is output from the projection lens 12 as light that is parallel with the axial line Ax. Therefore, light emitted from the prescribed point O can be output from the projection lens 12 as light that is parallel with the axial line Ax though the front surface 12*a* is a smooth free surface having no ridge lines. This prevents the problem that the lamp 10 is impaired in appearance due to formation of ridge lines in the front surface 12*a* of the projection lens 12.

As described above, according to the exemplary embodiment, the vehicular illumination lamp 10 having the projection lens 12 is prevented from being impaired in appearance though the front surface 12*a* of the projection lens 12 has the generally square perimeter 12*a*1.

Furthermore, in the vehicular illumination lamp 10 according to the exemplary embodiment, since the lens holder 20 which supports the projection lens 12 is disposed so as to surround the projection lens 12, the perimeter 12*a*1 of the front surface 12*a* of the projection lens 12 can be covered with the lens holder 20, whereby the appearance of the lamp 10 can be improved. Since no end surfaces are formed in the perimeter 12*a*1 of the front surface 12*a* of the projection lens 12, the front end surface 20*a* of the lens holder 20 can be made a flat surface having no projections or recesses over its entire circumference.

In the above exemplary embodiment, the light source 14 incorporating a white light-emitting diode is directed forward with the light emission center of the light-emitting chip 14*a* located at the prescribed point O. Alternatively, the light source 14 may be disposed in such a manner that the light emission center of the light-emitting chip 14*a* deviated from the prescribed point O. As a further alternative, the light source 14 may be disposed in such a manner that the light-emitting surface of the light-emitting chip 14*a* deviated from the prescribed point O in the front-rear direction.

Although in the exemplary embodiment the light-emitting chip 14*a* of the light source 14 has the rectangular light-emitting surface that is longer in the horizontal direction, it may naturally have a light-emitting surface having another shape (e.g., square shape).

In the exemplary embodiment, the perimeter 12*a*1 of the front surface 12*a* of the projection lens 12 extends along a plane that is perpendicular to the axial line Ax. However, it may extend approximately along a plane that is perpendicular to the axial line Ax. Also in this case, the projection lens 12 is can be configured so that almost no end surfaces that may produce stray light are formed in the perimeter 12*a*1 of the projection lens 12.

In the exemplary embodiment, the projection lens 12 is positioned and fixed in such a manner that the lens holder 20 which is disposed so as to surround the projection lens 12 which is in contact with the front end opening portion 18*a* is brought into contact with a portion, in the vicinity of the perimeter 12*a*1, of the front surface 12*a* of the projection lens 12. However, the projection lens 12 may be fixed to the front end opening portion 18*a* of the housing 18 by bonding or the like. In this case, instead of the lens holder 20, a decorative ring member may be disposed so as to surround the projection lens 12. Also in this configuration, the front end surface of the decorative ring member can be made a flat surface having no projections or recesses over its entire circumference.

Next, modifications of the exemplary embodiment will be described.

First, a first modification of the exemplary embodiment will be described.

Figure 6:
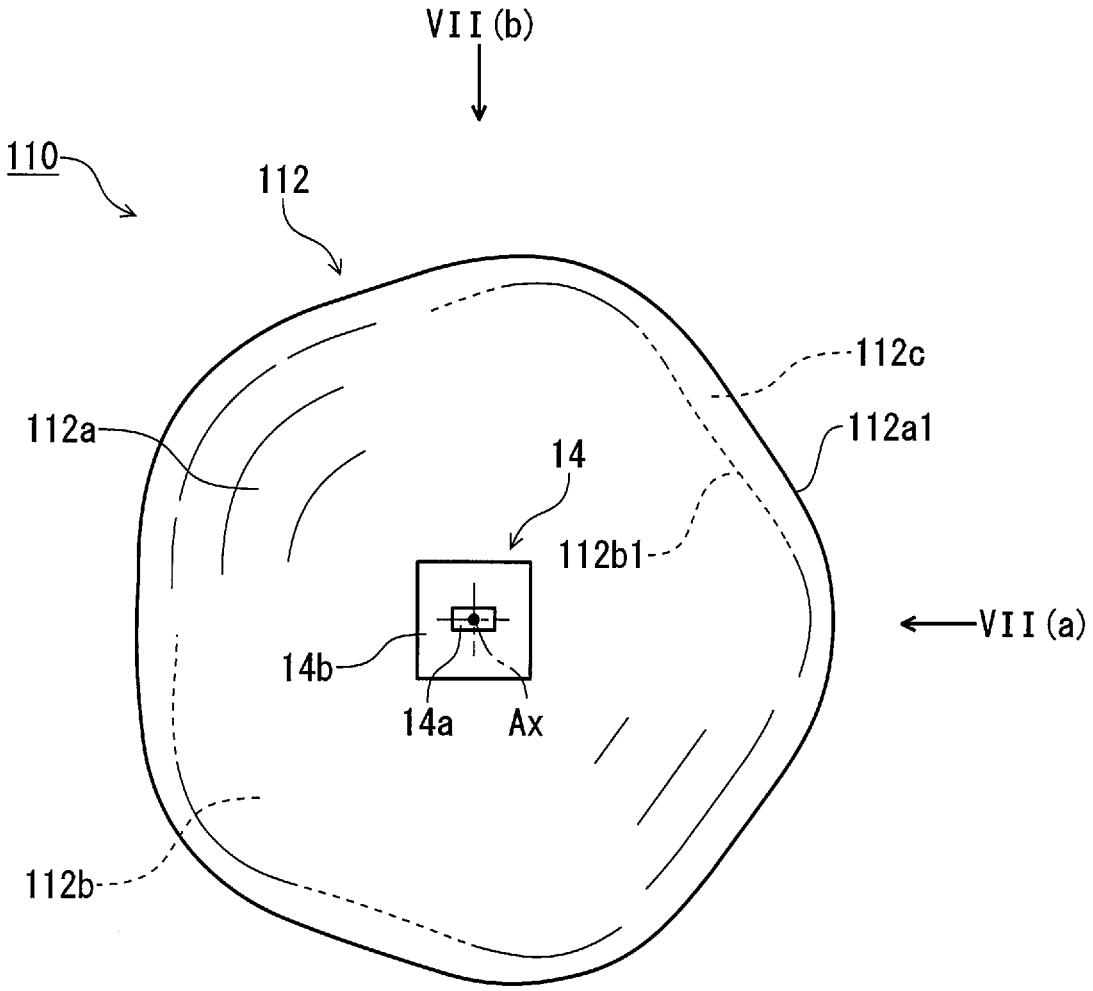
FIG. 6, which corresponds to FIG. 2, shows important members of a vehicular illumination lamp according to a first modification of the exemplary embodiment.
Figure 7A:
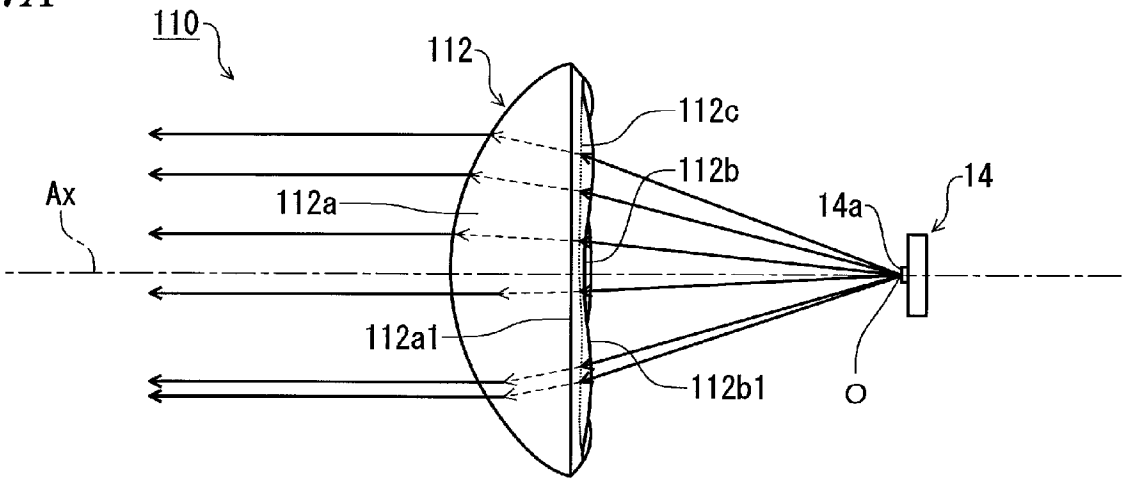
FIGS. 7A and 7B are side views as viewed from the directions VII(a) and VII(b) in FIG. 6, respectively.
Figure 7B:
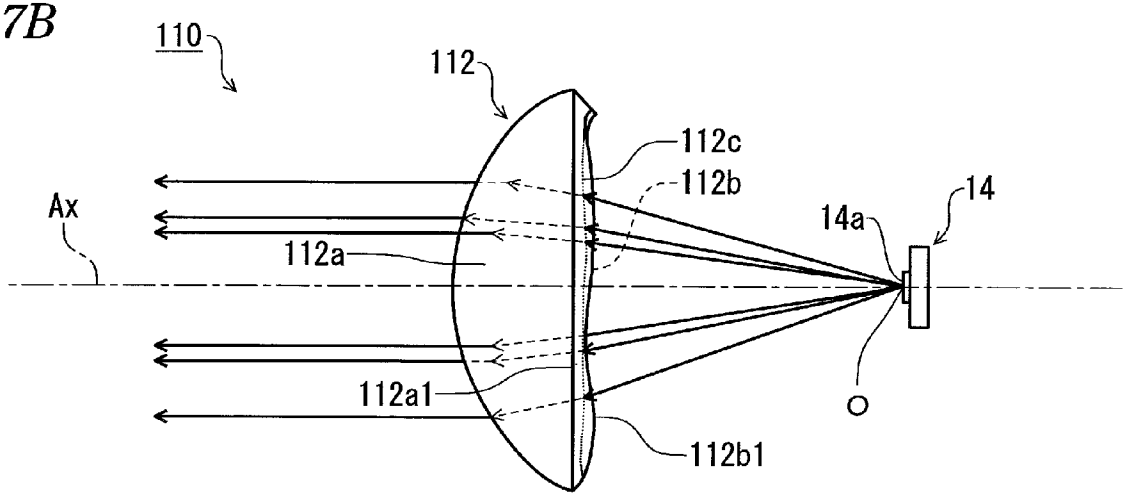
Figure 8:
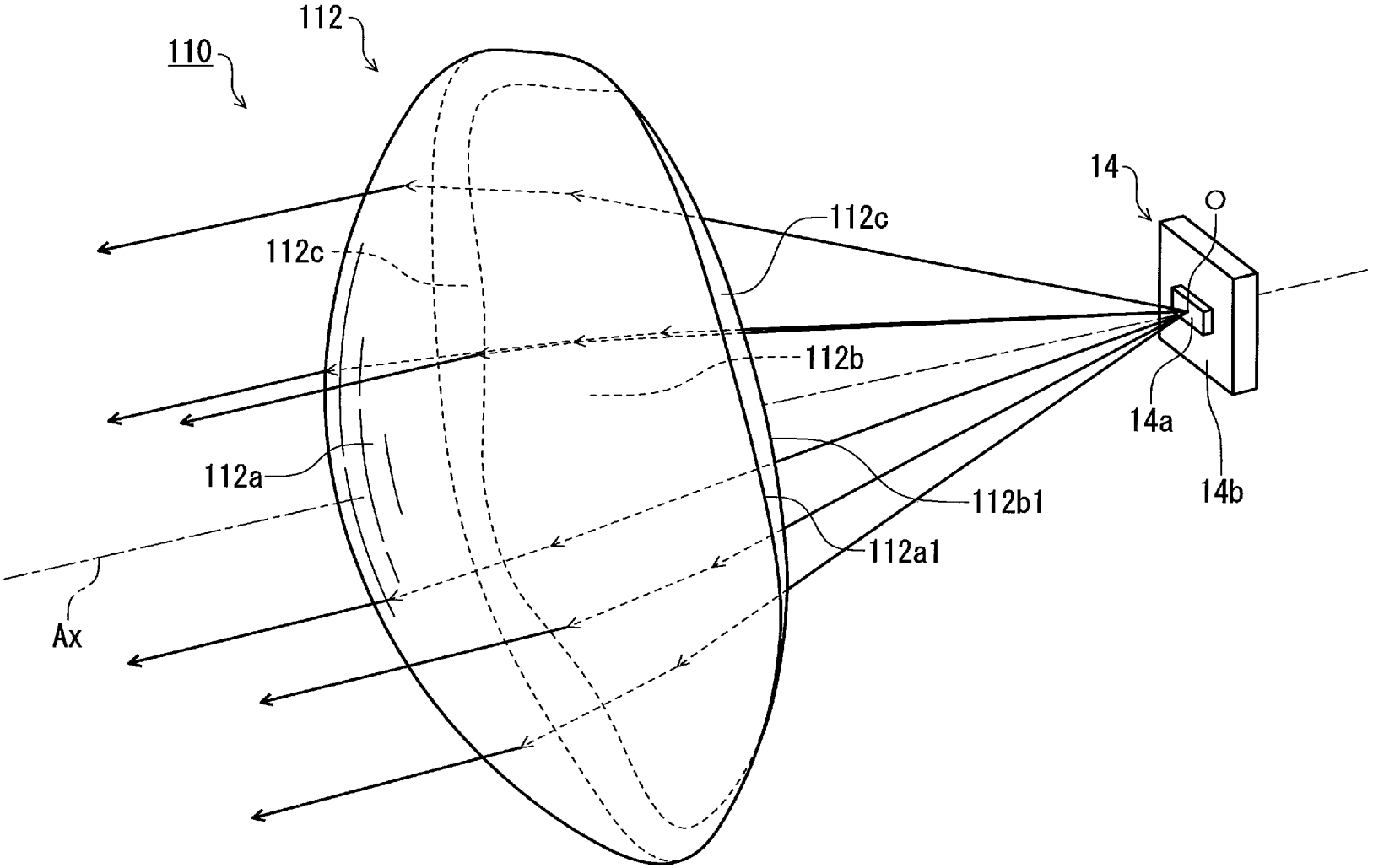
FIG. 8 is a perspective view showing the important members of the vehicular illumination lamp according to the first modification.

FIG. 6, which corresponds to FIG. 2, shows important members of a vehicular illumination lamp 110 according to this modification. FIGS. 7A and 7B are side views as viewed from the directions VII(a) and VII(b) in FIG. 6, respectively. FIG. 8 is a perspective view showing the important members of the vehicular illumination lamp 110.

As shown in these drawings, the vehicular illumination lamp 110 according to the modification is basically the same in configuration as the vehicular illumination lamp 10 according to the exemplary embodiment but a projection lens 112 of the vehicular illumination lamp 110 is partly different from the projection lens 12 of the vehicular illumination lamp 10.

In the modification, in a front view, the projection lens 112 has a generally regular-pentagonal external shape having the axial line Ax as a center line.

A front surface 112*a* of the projection lens 112 is a convex free surface. A perimeter 112*a*1 of the front surface 112*a* extends along a plane that is perpendicular to the axial line Ax. In a front view, five portions of the perimeter 112*a*1 are straight lines that are parts of the respective sides of a regular pentagon and the other portions are curved lines.

On the other hand, a rear surface 112*b* of the projection lens 112 is a curved surface that is formed so that light emitted from a prescribed point O and incident on the projection lens 112 is output from the projection lens 112 as light that is parallel with the axial line Ax.

A perimeter 112*b*1 of the rear surface 112*b* is formed in a wave-shape in the front-rear direction with respect to a plane that is perpendicular to the axial line Ax. The perimeter 112*b*1 of the rear surface 112*b* is located in the rear of the perimeter 112*a*1 of the front surface 112*a*.

A ring-shaped slant surface 112*c* is formed between the perimeter 112*b*1 of the rear surface 112*b* and the perimeter 112*a*1 of the front surface 112*a*.

Next, advantages of the modification will be described below.

Also in the vehicular illumination lamp 110 according to the modification, since the front surface 112*a* of the projection lens 112 is a convex free surface, the degree of freedom of lamp designing is increased.

Since the perimeter 112*a*1 of the front surface 112*a* of the projection lens 112 extends along a plane that is perpendicular to the axial line Ax extending in the lamp front-rear direction, no end surfaces that may produce stray light are formed in the perimeter 112*a*1 of the projection lens 112 though the perimeter 112*a*1 has a non-circular shape (i.e., generally regular-pentagonal shape). This makes it unnecessary to cover such end surfaces with a lens holder which supports the projection lens 112. This prevents the problem that the lamp 110 is impaired in appearance.

The rear surface 112*b* of the projection lens 112 is a curved surface that is formed so that light emitted from the prescribed point O and incident on the projection lens 112 is output from the projection lens 112 as light that is parallel with the axial line Ax. Therefore, light emitted from the prescribed point O can be output from the projection lens 112 as light that is parallel with the axial line Ax though the front surface 112*a* is a smooth free surface having no ridge lines. This prevents the problem that the lamp 110 is impaired in appearance due to formation of ridge lines in the front surface 112*a* of the projection lens 112.

As described above, according to the modification, the vehicular illumination lamp 110 having the projection lens 112 is prevented from being impaired in appearance though the front surface 112*a* of the projection lens 112 has the generally regular-pentagonal perimeter 112*a*1.

Next, a second modification of the exemplary embodiment will be described.

Figure 9:
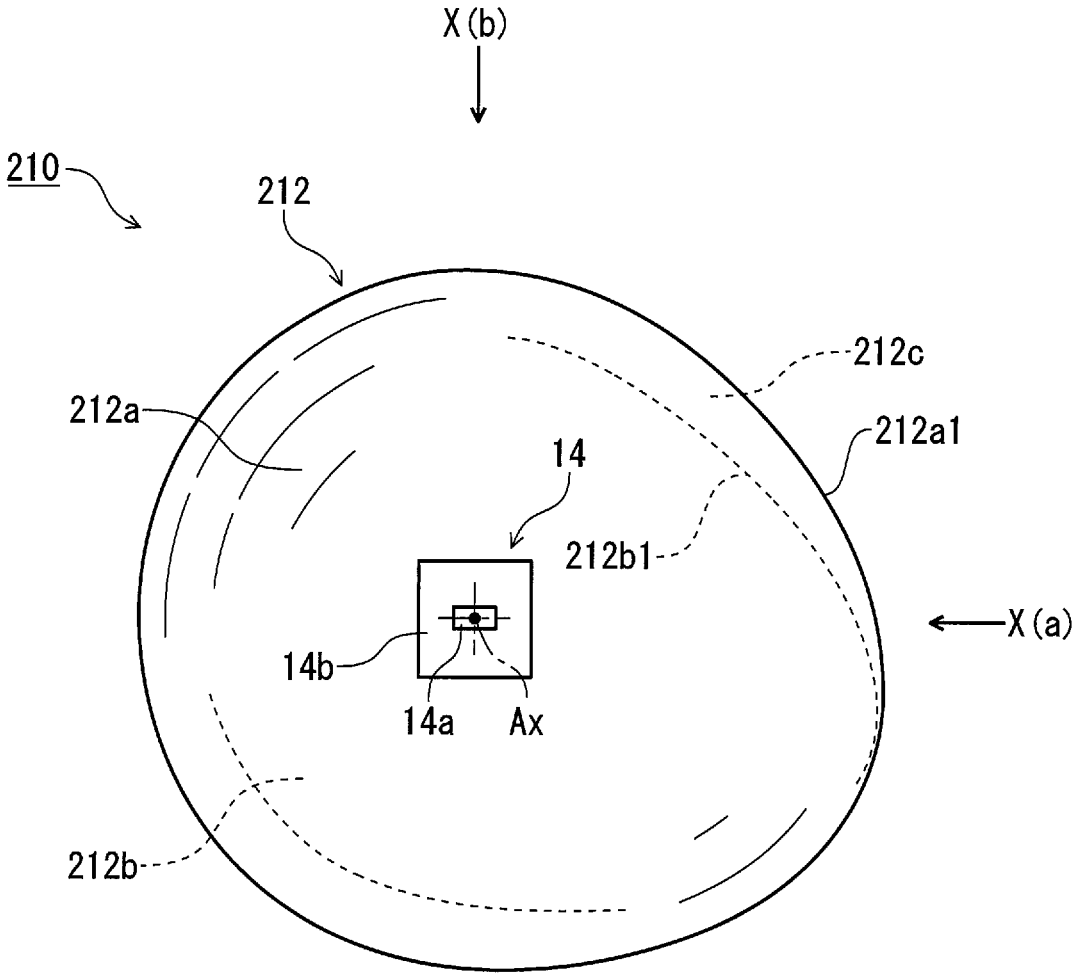
FIG. 9, which corresponds to FIG. 2, shows important members of a vehicular illumination lamp according to a second modification of the exemplary embodiment.
Figure 10A:
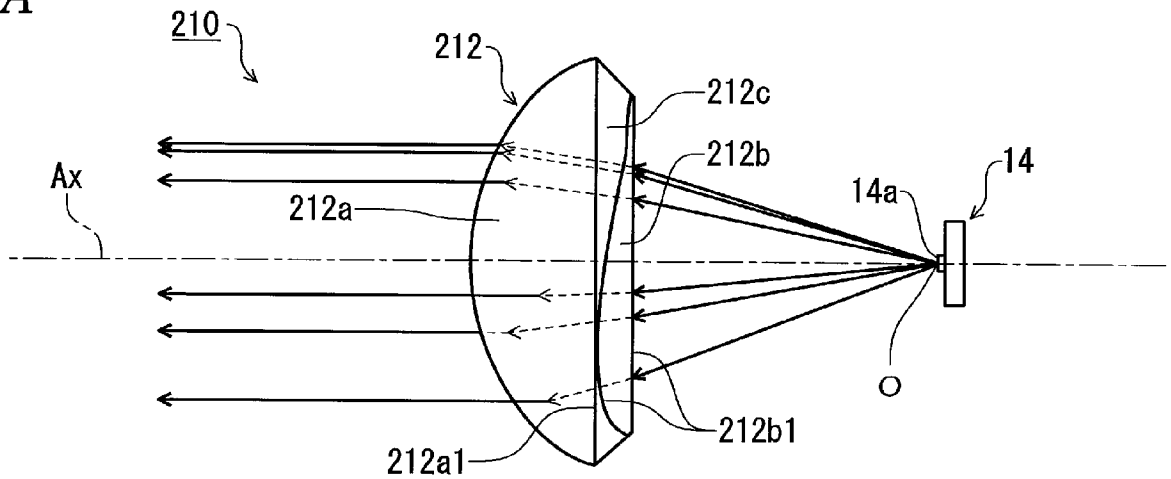
FIGS. 10A and 10B are side views as viewed from the directions X(a) and X(b) in FIG. 9, respectively.
Figure 10B:
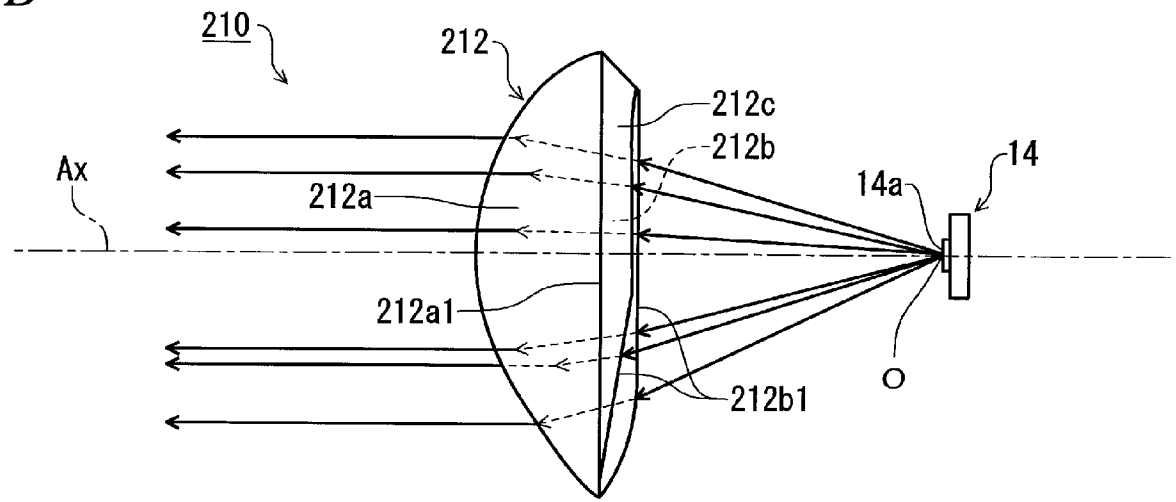
Figure 11:
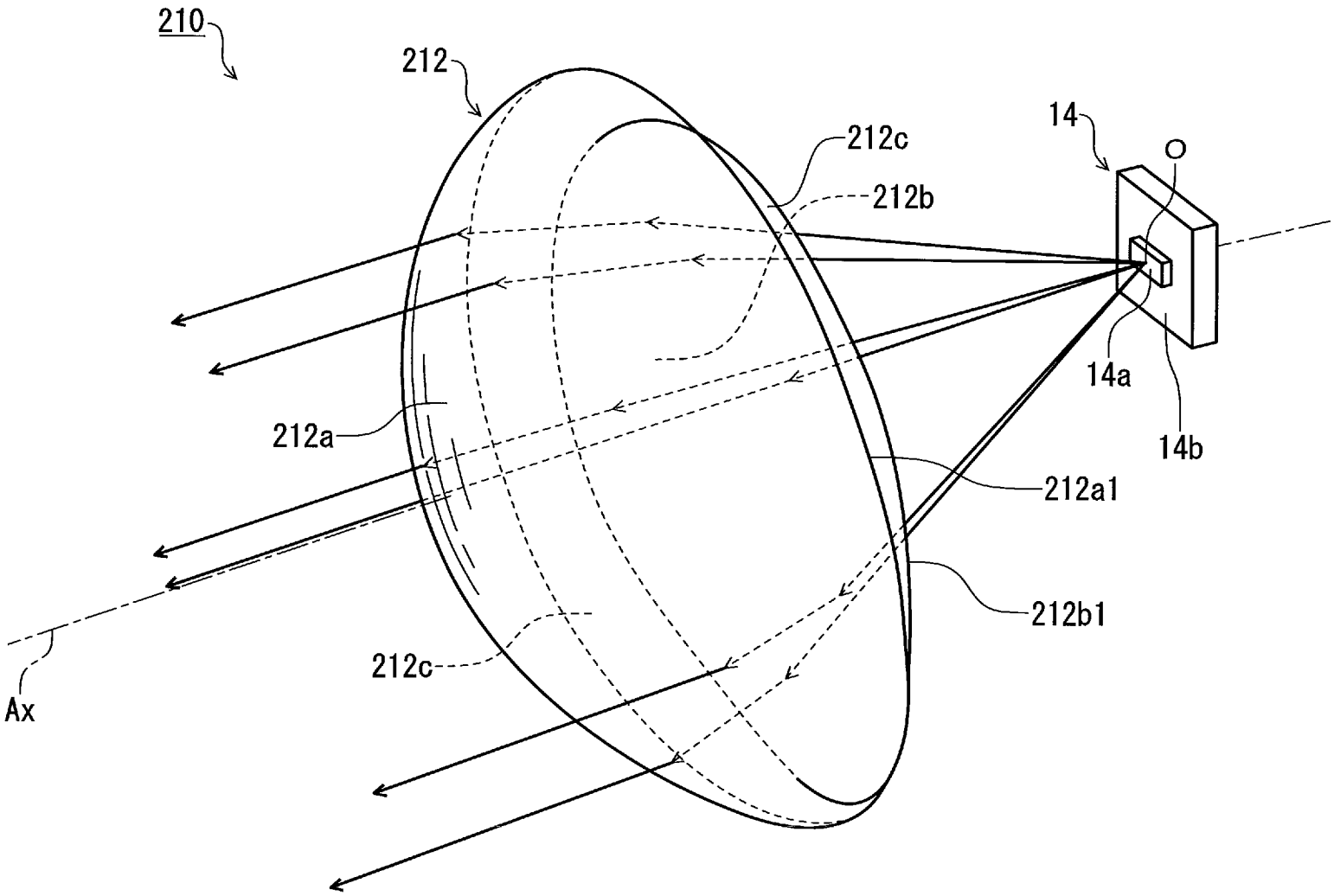
FIG. 11 is a perspective view showing the important members of the vehicular illumination lamp according to the second modification.

FIG. 9, which corresponds to FIG. 2, shows several members of a vehicular illumination lamp 210 according to this modification. FIGS. 10A and 10B are side views as viewed from the directions X(a) and X(b) in FIG. 9, respectively. FIG. 11 is a perspective view showing the members of the vehicular illumination lamp 210.

As shown in these drawings, the vehicular illumination lamp 210 according to the modification is basically the same in configuration as the vehicular illumination lamp 10 according to the exemplary embodiment but a projection lens 212 of the vehicular illumination lamp 210 is partly different from the projection lens 12 of the vehicular illumination lamp 10.

In the modification, in a front view, the projection lens 212 has an egg-like external shape having the axial line Ax approximately as a center line.

A front surface 212*a* of the projection lens 212 is a convex free surface. A perimeter 212*a*1 of the front surface 212*a* extends along a plane that is perpendicular to the axial line Ax. The perimeter 212*a*1 is a curve formed by smoothly connecting plural curves having different radii of curvature.

On the other hand, a rear surface 212*b* of the projection lens 212 is a curved surface that is formed so that light emitted from a prescribed point O and incident on the projection lens 212 is output from the projection lens 212 as light that is parallel with the axial line Ax.

A perimeter 212*b*1 of the rear surface 212*b* is formed in a wave-shape in the front-rear direction with respect to a plane that is perpendicular to the axial line Ax. The perimeter 212*b*1 of the rear surface 212*b* is located in the rear of the perimeter 212*a*1 of the front surface 212*a*.

A ring-shaped slant surface 212*c* is formed between the perimeter 212*b*1 of the rear surface 212*b* and the perimeter 212*a*1 of the front surface 212*a*.

Next, advantages of the modification will be described below.

Also in the vehicular illumination lamp 210 according to the modification, since the front surface 212*a* of the projection lens 212 is a convex free surface, the degree of freedom of lamp designing is increased.

Since the perimeter 212*a*1 of the front surface 212*a* of the projection lens 212 extends along a plane that is perpendicular to the axial line Ax extending in the lamp front-rear direction, no end surfaces that may produce stray light are formed in the perimeter 212*a*1 of the projection lens 212 though the perimeter 212*a*1 has a non-circular shape (i.e., egg shape). This makes it unnecessary to cover such end surfaces with a lens holder which supports the projection lens 212. This prevents the problem that the lamp 210 is impaired in appearance.

The rear surface 212*b* of the projection lens 212 is a curved surface that is formed so that light emitted from the prescribed point O and incident on the projection lens 212 is output from the projection lens 212 as light that is parallel with the axial line Ax. Therefore, light emitted from the prescribed point O can be output from the projection lens 212 as light that is parallel with the axial line Ax though the front surface 212*a* is a smooth free surface having no ridge lines. This prevents the problem that the lamp 210 is impaired in appearance due to formation of ridge lines in the front surface 212*a* of the projection lens 212.

As described above, according to the modification, the vehicular illumination lamp 210 having the projection lens 212 is prevented from being impaired in appearance though the front surface 212*a* of the projection lens 212 has the egg-shaped perimeter 212*a*1.

Next, a third modification of the exemplary embodiment will be described.

Figure 12:
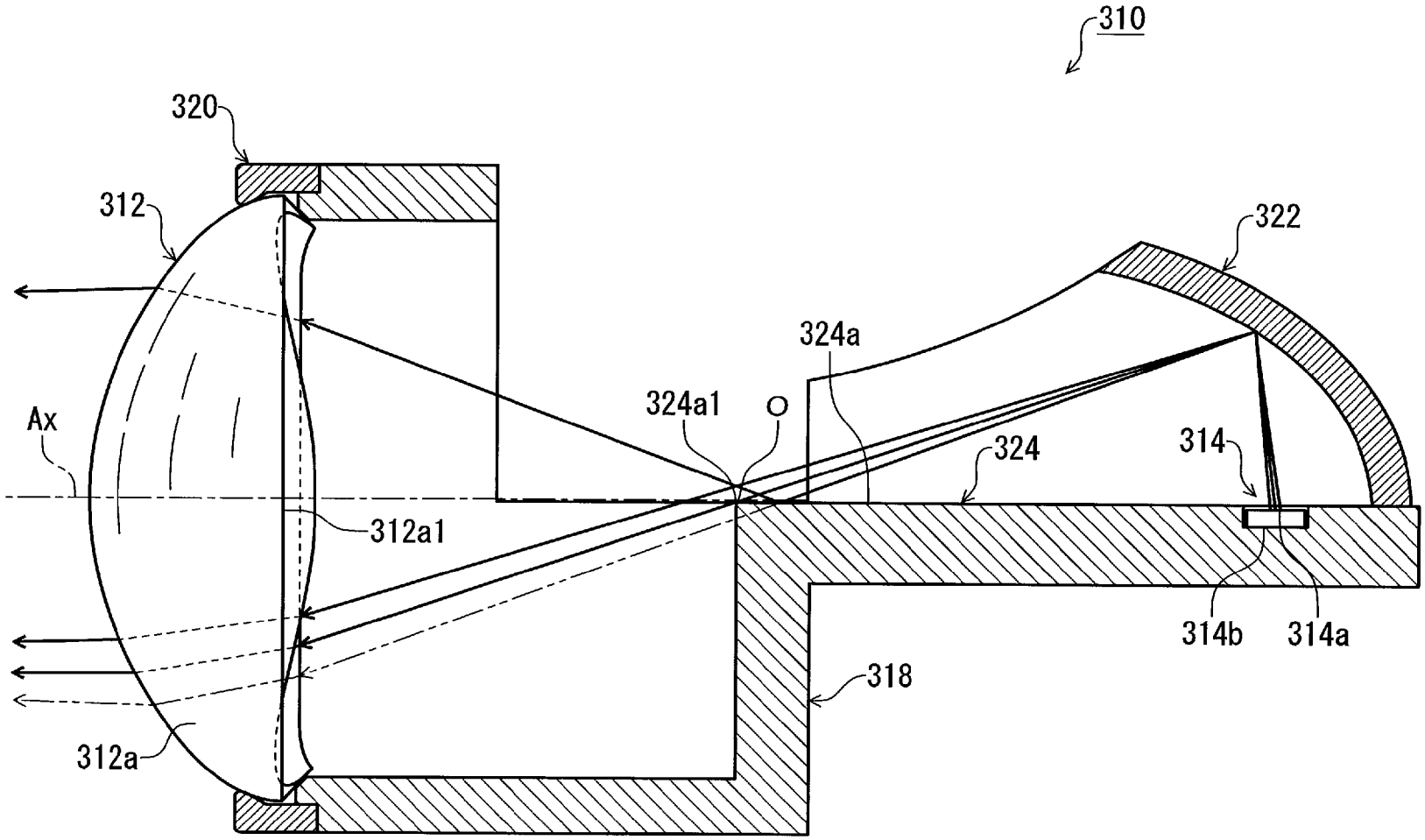
FIG. 12, which corresponds to FIG. 1, shows a vehicular illumination lamp according to a third modification of the exemplary embodiment.

FIG. 12, which corresponds to FIG. 1, shows a vehicular illumination lamp 310 according to this modification.

As shown in FIG. 12, whereas a projection lens 312 of the vehicular illumination lamp 310 according to the modification is the same in configuration as the projection lens 12 used in the exemplary embodiment, the vehicular illumination lamp 310 according to this modification is different from the vehicular illumination lamp 10 according to the exemplary embodiment in that the former is a projector-type lamp unit and the latter is a direct projection type lamp unit.

More specifically, the vehicular illumination lamp 310 according to the modification is equipped with a light source 314 which is disposed in the rear of the prescribed point O and directed upward, a reflector 322 which is disposed so as to cover the light source 314 from above and reflects light coming from the light source 314 toward the projection lens 312, and a mirror member 324 having an upward reflection surface 324*a* for reflecting upward part of light reflected from the reflector 322. The mirror member 324 is disposed so that a front edge 324*a*1 of the upward reflection surface 324*a* passes the prescribed point O.

The light source 314 is equipped with a light-emitting chip 314*a* which is a white light-emitting diode and has a rectangular light-emitting surface that is longer in the horizontal direction and a substrate 314*b* which supports the light-emitting chip 314*a*. The light source 314 is directed upward with the light emission center of the light-emitting chip 314*a* located on the axial line Ax. The light source 314 is supported by a base member 318 via the substrate 314*b*.

The reflector 322 is attached to the base member 318, and a lens holder 320 which supports the projection lens 312 is also attached to the base member 318. The mirror member 324 is integral with the base member 318.

Figure 13:
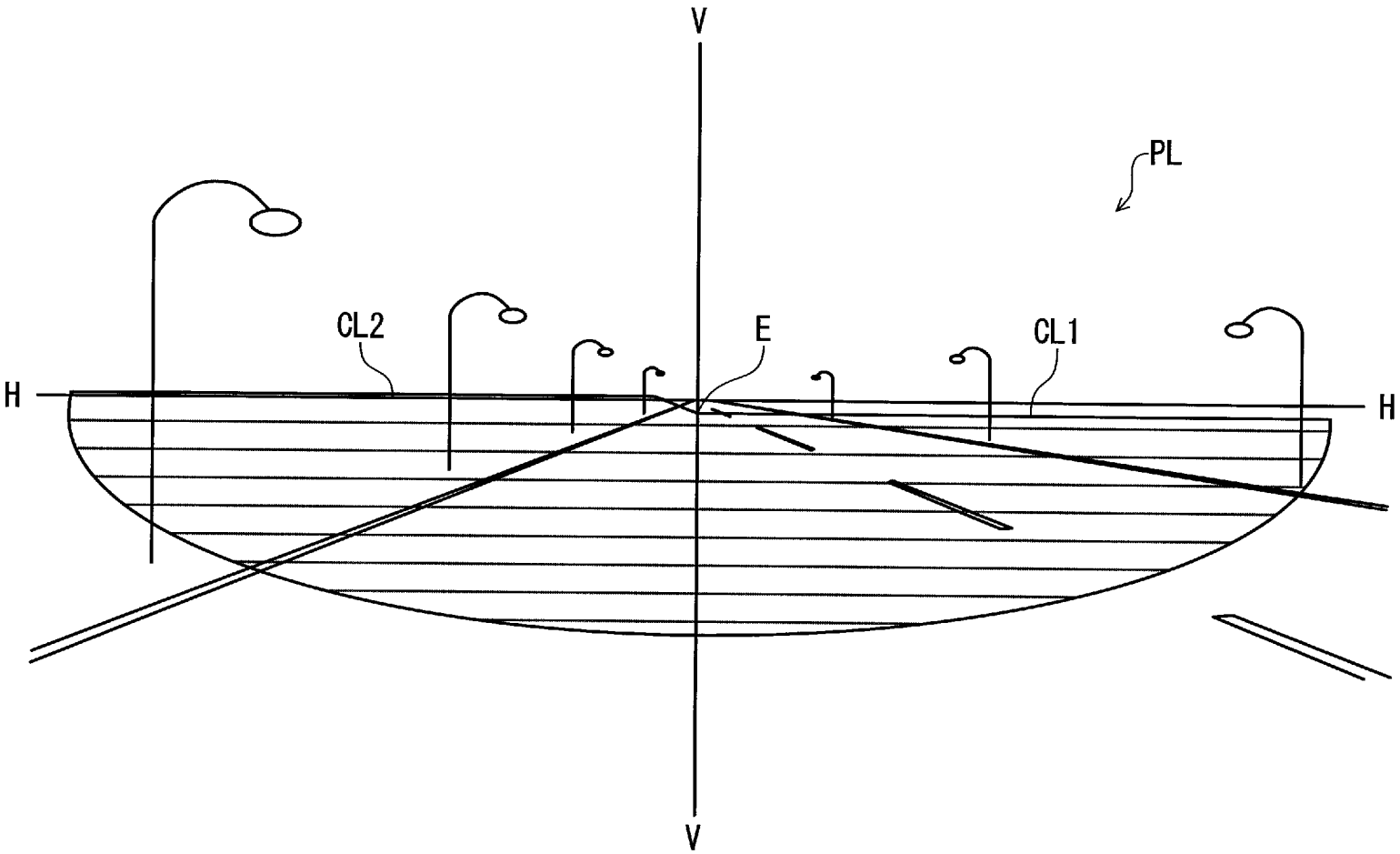
FIG. 13, which corresponds to FIG. 5, shows an advantageous light distribution pattern of the third modification.

FIG. 13 shows, in seethrough form, a low-beam light distribution pattern PL that is formed on a virtual vertical screen located 25 m before the vehicle by light that is projected forward by the vehicular illumination lamp 310 according to the modification.

The low-beam light distribution pattern PL is a left-hand low-beam light distribution pattern and its top edge is formed with a right cutoff line CL1 and a left cutoff line CL2 that have a height difference. The cutoff lines CL1 and CL2 extend in the horizontal direction with the height difference on the right side and the left side, respectively, of a vertical V-V line that passes a forward vanishing point H-V. The lower-level cutoff line CL1 is located on the right side (opposite-lane side) of the V-V line, and the upper-level cutoff line CL2 is located on the left side (self-lane side) of the V-V line and is connected to the cutoff line CL1 by an inclined line.

The low-beam light distribution pattern PL is formed by the projection lens 312 by projecting an image of the light source 314 formed on a rear focal plane of the projection lens 312 by light emitted from the light source 314 and reflected by the reflector 322 onto the above-mentioned virtual vertical screen as an inverted projection image. The cutoff lines CL1 and CL2 are formed as inverted projection images of the front edge 324*a*1 of the upward reflection surface 324*a* of the mirror member 324.

In the low-beam light distribution pattern PL, an elbow point E which is an intersecting point of the lower-level cutoff line CL1 and the V-V line is deviated downward from the vanishing point H-V by about 0.5° to 0.6°. To this end, in the vehicular illumination lamp 310, the optical axis is adjusted so that the axial line Ax goes down slightly toward the front side.

The projector-type lamp configuration as in this modification can also provides the same advantages as provided by the exemplary embodiment. That is, the vehicular illumination lamp 310 according to the modification is prevented from being impaired in appearance though a front surface 312*a* of the projection lens 312 has a generally square perimeter 312*a*1.

In the vehicular illumination lamp 310 according to the third modification, the mirror member 324 may be omitted and a shade for interrupting part of light reflected from the reflector 322 may be disposed in place of the mirror member 324.

The invention has been described and illustrated by an exemplary embodiment and several modifications. It will be appreciated, however, that the invention can be applied otherwise, and that the dimensions, materials and other variables may be altered to suit individual design considerations without departing from the spirit and scope of the present invention.

What is claimed is:

1. A vehicular illumination lamp comprising:

a projection lens configured to output forward, as light that is parallel with an axial line extending in a lamp front-rear direction, light emitted from a prescribed point on the axial line; and a light source disposed in the rear of the projection lens, wherein a front surface of the projection lens is a convex free surface and a perimeter of the front surface extends approximately along a plane that is perpendicular to the axial line; and a rear surface of the projection lens is a curved surface which is formed so that light emitted from the prescribed point and incident on the projection lens is output from the projection lens as light that is parallel with the axial line, wherein the perimeter of the front surface of the projection lens forms a non-circular shape having a plurality of straight portions and one or more front corner portions located between the straight portions, and a perimeter of the rear surface is formed having portions corresponding to the respective straight portions which are deviated in a direction away from the perimeter of the front surface, and rear corner portions corresponding to the front corner portions which are deviated in a direction toward the perimeter of the front surface.

2. The vehicular illumination lamp according to claim 1, wherein a lens holder which supports the projection lens is disposed so as to surround the projection lens.

3. The vehicular illumination lamp according to claim 2, wherein a front end surface of the lens holder extends along the plane that is perpendicular to the axial line.

4. The vehicular illumination lamp according to claim 1, wherein a perimeter of the rear surface of the projection lens is formed in a wave-shape in the front-rear direction with respect to a plane that is perpendicular to the axial line.

5. The vehicular illumination lamp according to claim 2, wherein the lens holder positions and fixes the projection lens to a housing.

6. The vehicular illumination lamp according to claim 2, wherein a flange portion extends inward from a front end surface of the lens holder so as to contact the convex free surface at the front surface of the projection lens.

* * * * *